US009605919B2

(12) United States Patent
Wengender

(10) Patent No.: US 9,605,919 B2
(45) Date of Patent: Mar. 28, 2017

(54) LOCKING FIREARM SAFETY

(71) Applicant: David J. Wengender, Heath, TX (US)

(72) Inventor: David J. Wengender, Heath, TX (US)

( * ) Notice: Subject to any disclaimer, the term of this patent is extended or adjusted under 35 U.S.C. 154(b) by 0 days.

(21) Appl. No.: 14/791,454

(22) Filed: Jul. 5, 2015

(65) Prior Publication Data

US 2016/0187089 A1 Jun. 30, 2016

Related U.S. Application Data

(60) Provisional application No. 62/021,173, filed on Jul. 6, 2014.

(51) Int. Cl.
*F41A 17/02* (2006.01)
*F41A 17/64* (2006.01)
*F41A 17/74* (2006.01)

(52) U.S. Cl.
CPC ..... *F41A 17/02* (2013.01); *F41A 17/64* (2013.01); *F41A 17/74* (2013.01)

(58) Field of Classification Search
CPC ..... F41A 17/46; F41A 17/52; F41A 17/56; F41A 17/64; F41A 17/74; F41A 17/02
USPC ..... 42/70.06, 70.04, 70.05, 70.08
See application file for complete search history.

(56) References Cited

U.S. PATENT DOCUMENTS

| | | | | |
|---|---|---|---|---|
| 2,821,040 A * | 1/1958 | Tatman | F41A 17/52 | 42/41 |
| 3,553,877 A * | 1/1971 | Welch et al. | F41A 17/02 | 42/70.01 |
| 7,726,059 B2 * | 6/2010 | Pikielny | F41A 35/06 | 42/70.05 |
| 2013/0111796 A1 * | 5/2013 | Dionne | F41A 17/00 | 42/70.11 |

* cited by examiner

*Primary Examiner* — Stephen M Johnson
(74) *Attorney, Agent, or Firm* — Seth A. Horwitz

(57) ABSTRACT

Methods and systems for locking and operating firearms, particularly rifle models that have a safety selector that extends through the width of the weapon body. For example, a safety selector lock can be configured to attach to the lower receiver of an AR-15. A replacement, extended safety selector allows installation of a safety selector lock outside the body of the firearm, avoiding modification of the weapon's firing components. The safety selector is locked by an engagement pin engaging an engagement hole on a locking cap connected to an end of the safety selector, outside the weapon body. Some weapons have two SAFE positions; disclosed embodiments can provide two DIFFERENT SAFE positions—a OPEN SAFE (unlocked) and a LOCKED SAFE. By using an engagement hole with a single opening, the engagement pin engages the engagement hole, thus locking the safety selector, in only one of the SAFE positions.

44 Claims, 10 Drawing Sheets

2/

LOCKING FIREARM SAFETY

CROSS-REFERENCE

This application is a non-provisional of U.S. Provisional Pat. App. No. 62/021,173, filed Jul. 6, 2014, which is hereby incorporated by reference.

BACKGROUND

The present application relates to methods, devices and systems for locking firearms to prevent weapon discharge; and more particularly to lockable rifle safety selectors.

Note that the points discussed below may reflect the hindsight gained from the disclosed inventions, and are not necessarily admitted to be prior art.

The AR-15 is a lightweight, intermediate cartridge magazine-fed, air-cooled rifle with a rotating lock bolt, actuated by direct impingement gas operation or long/short stroke piston operation. The civilian and sport AR-15 has proven a successful and popular weapons design, with millions of units sold and used throughout the world. The M16 (and its descendant M16 versions), a long-time standard weapon of U.S. infantry forces, is also based on the AR-15 design.

One significant feature of the AR-15 design is the designed and specified interchangeability of the firearm's components. The AR-15 design, including manufacturing tolerances and other specifications, is publicly available. This publicly available design allows AR-15 units to be easily and/or affordably produced with sufficient precision to allow generally universal interchangeability between most or all AR-15 parts produced by the various different manufacturers complying with the standard AR-15 design specifications. For example, a trigger assembly from one AR-15 can be used in another AR-15 simply by swapping the parts from one firearm into the other.

BRIEF DESCRIPTION OF THE DRAWINGS

The disclosed inventions will be described with reference to the accompanying drawings, which show important sample embodiments and which are incorporated in the specification hereof by reference, wherein.

DETAILED DESCRIPTION OF SAMPLE EMBODIMENTS

Figure 1:
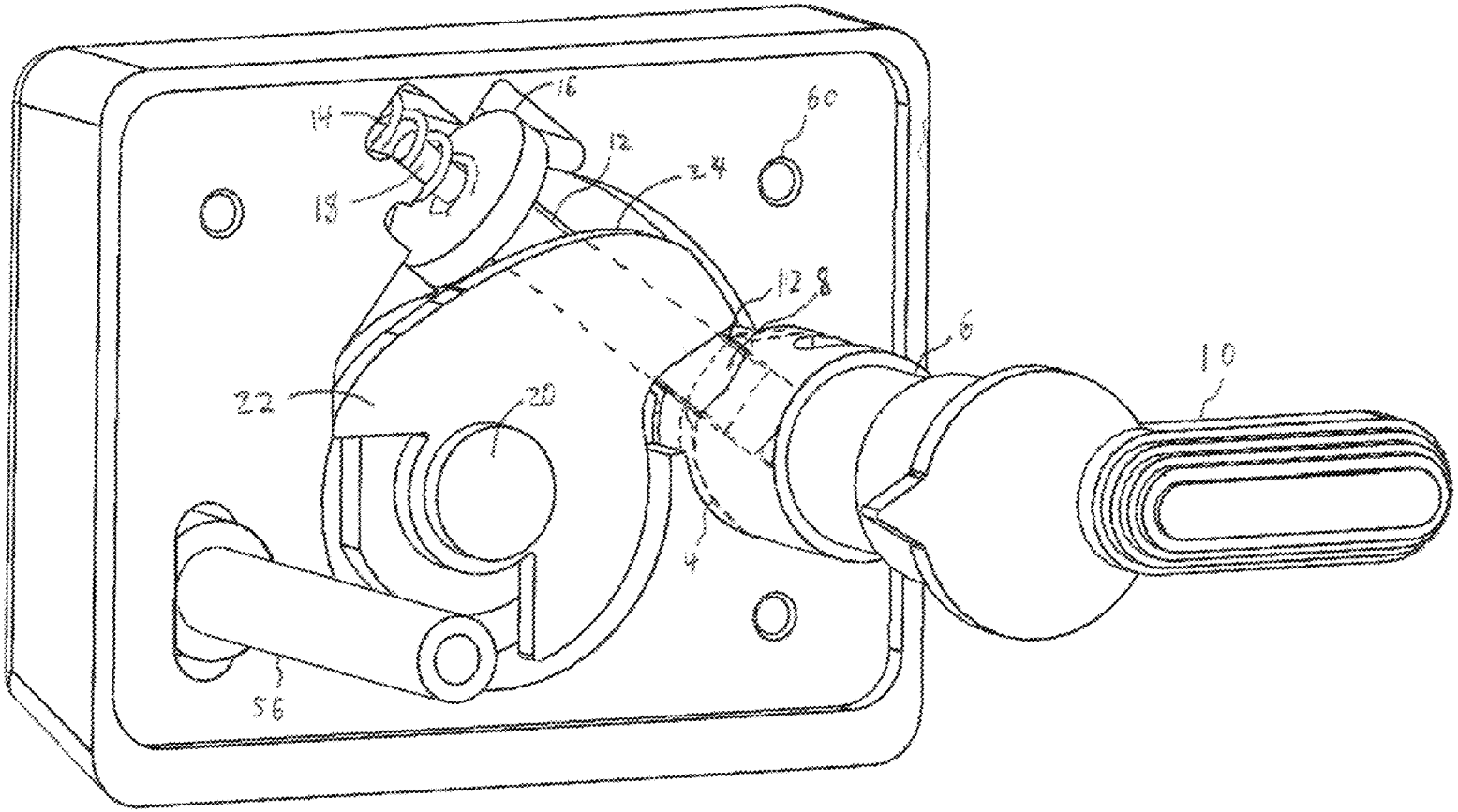
FIG. 1 schematically shows a safety selector lock.

The numerous innovative teachings of the present application will be described with particular reference to presently preferred embodiments (by way of example, and not of limitation). The present application describes several inventions, and none of the statements below should be taken as limiting the claims generally.

The present application discloses new approaches to locking firearms to prevent undesired weapon discharge.

The inventor has discovered that in rifles with a safety selector that extends through the width of the lower receiver, a safety selector lock can advantageously be shifted outside the body of the lower receiver by extending the safety selector pin.

The inventor has also discovered that in rifles (such as the AR-15) with two SAFE positions for the safety selector, a safety selector lock can advantageously have TWO different SAFE positions: a LOCKED SAFE position, requiring a key to disengage the lock and allow selection of the FIRE position, and a OPEN SAFE position, which allows immediate selection of the FIRE position as per normal (unmodified) firearm operation.

The disclosed innovations, in various embodiments, provide one or more of at least the following advantages. However, not all of these advantages result from every one of the innovations disclosed, and this list of advantages does not limit the various claimed inventions.

- locking safety remains attached to firearm during firearm use;
- can be made robust and lightweight;
- does not require modification of interior of firearm;
- does not require modification of lower receiver;
- lock can be located near the trigger, enhancing convenience and ease of use;
- minimal additional work to maintain firearm with locking safety installed;
- allows for two (or more) different SAFE positions, including a locked SAFE position and an unlocked SAFE position;
- customizable;
- lock engages automatically when the safety selector lever is moved to SAFE position; and
- the firearm can become inoperable if the lock is removed improperly.

Some exemplary parameters will be given to illustrate the relations between these and other parameters. However it will be understood by a person of ordinary skill in the art that these values are merely illustrative, and will be modified by scaling of further device generations, and will be further modified to adapt to different materials or architectures if used.

Firearm safety and security are perennial concerns attached to gun ownership and care. Prevention of discharge by accident, or by a thief or other unauthorized user, is typically considered a necessary part of responsible gun use. Many gun owners keep their guns disassembled, in a locked safe, or with firearm and ammunition physically separated, to exert control over who can use the weapon and when.

A firearm lock that prevents undesired use can enhance the value of the firearm, provide peace of mind, and allow the firearm to be securely and safely kept in a manner more convenient for immediate use by a user with the matching key. However, original equipment manufacturer ("OEM") safety selectors (typically, no more nor less than set forth in the AR-15 specifications) are generally not lockable.

An easily installed, reliable, robust, lightweight firearm lock that allows use with a highly popular design and/or type of firearm, such as the AR-15 and similar rifles, can help encourage widespread adoption of this advantageous security feature.

Preferred embodiments apply to rifles, such as the AR-15, that use a safety selector that extends through the width of the lower receiver. A replacement, extended safety selector can be used that allows a locking mechanism to be installed that does not modify the interior of the rifle and has minimal effect on ease of firearm maintenance.

Generally, when a safety selector is in a SAFE position, the firearm cannot be discharged, and when the safety selector is in a READY position, the firearm can be discharged.

Many AR-15s, as manufactured, have safety selectors with two SAFE positions (generally with identical function), typically separated by 180 degrees rotation of the safety selector (generally effectuated by rotation of a safety selector lever connected to or integrally formed with one end of the safety selector).

FIG. 1 schematically shows a safety selector lock 2. An assembled safety lock 100 (further described with respect to, e.g., FIG. 5) also comprises a cover plate 70 (further described with respect to, e.g., FIG. 4).

Figure 2:
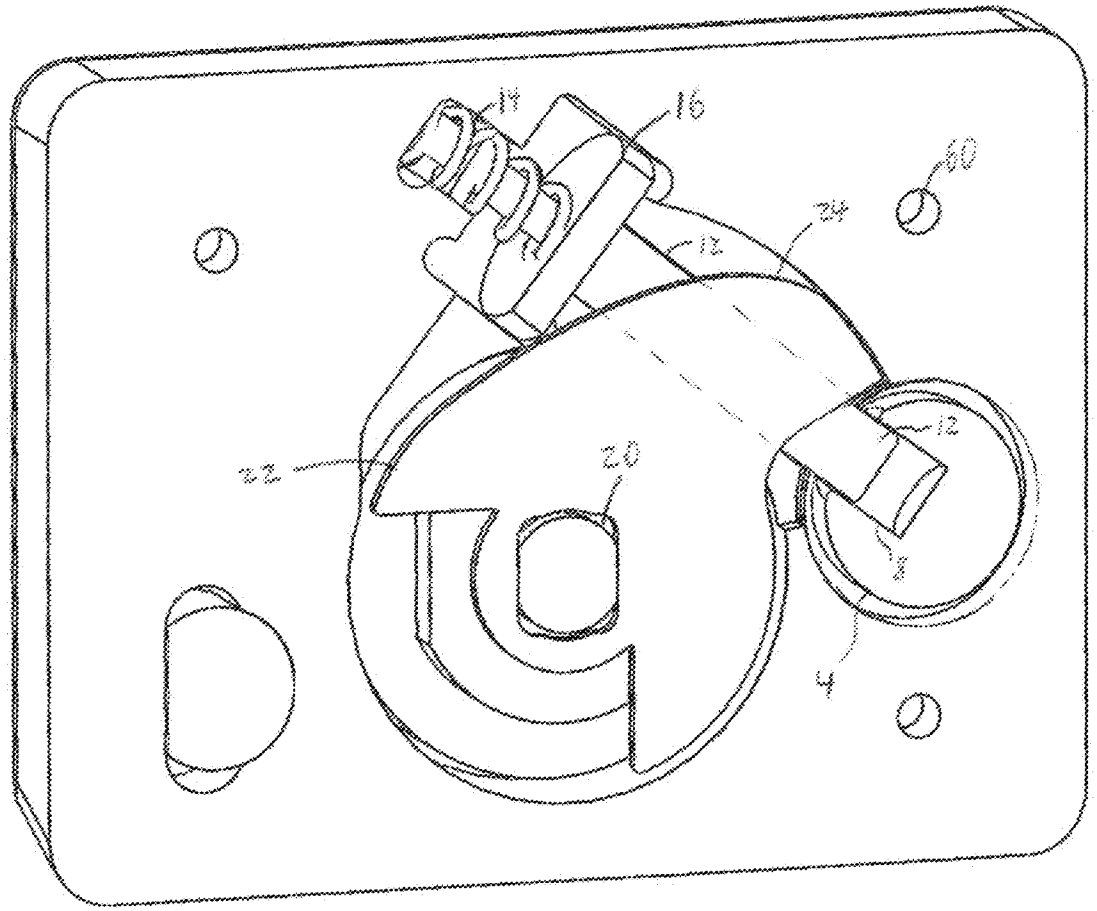
FIG. 2 schematically shows a safety selector lock.

FIG. 2 schematically shows a safety selector lock 2 (without a cover plate 70, and with some portions not shown, for visibility).

In preferred embodiments, as shown in FIGS. 1 and 2, a locking cap 4 is attached to the end of an extended safety selector 6 (see FIG. 5) which replaces the OEM (or other) safety selector. The locking cap 4 comprises one or more engagement holes 8, partially or fully penetrating the locking cap 4.

The extended safety selector 6 connects to or is integrally formed with the locking cap 4, such that when the assembled safety lock 100 is mounted on a firearm body 202, the locking cap 4 is exterior to the firearm body 202 (generally, on the side opposite the safety selector lever 10). The protrusion is sufficient to securely attach to the locking cap 4, such that the engagement hole 8 can be engaged by an engagement pin 12 that is also external to the firearm body 202. When a user rotates the safety selector lever 10 into a SAFE position, the locking cap 4 rotates to align the engagement hole 8 with and be engaged by the engagement pin 12. In a SAFE position, a safety selector prevents firearm discharge, typically by preventing actuation of the firearm's trigger assembly.

The engagement pin 12 engaging the engagement hole 8 locks the locking cap 4 in the SAFE position (i.e., prevents the locking cap 4, and therefore the extended safety selector 6, from turning; for example, because the engagement pin 12 is held by the safety lock so that it is unable to move laterally with respect to its direction of engagement/disengagement). The engagement pin 12 is caused (e.g., pushed or pulled) to engage the engagement hole 8 by a spring 14 pressing on a resistance plate 16 fixedly connected to the engagement pin 12. The spring is guided by a spring guide portion 18 of the engagement pin 12 (on the opposite side of the resistance plate 16 from the locking cap 4).

Figure 3A:
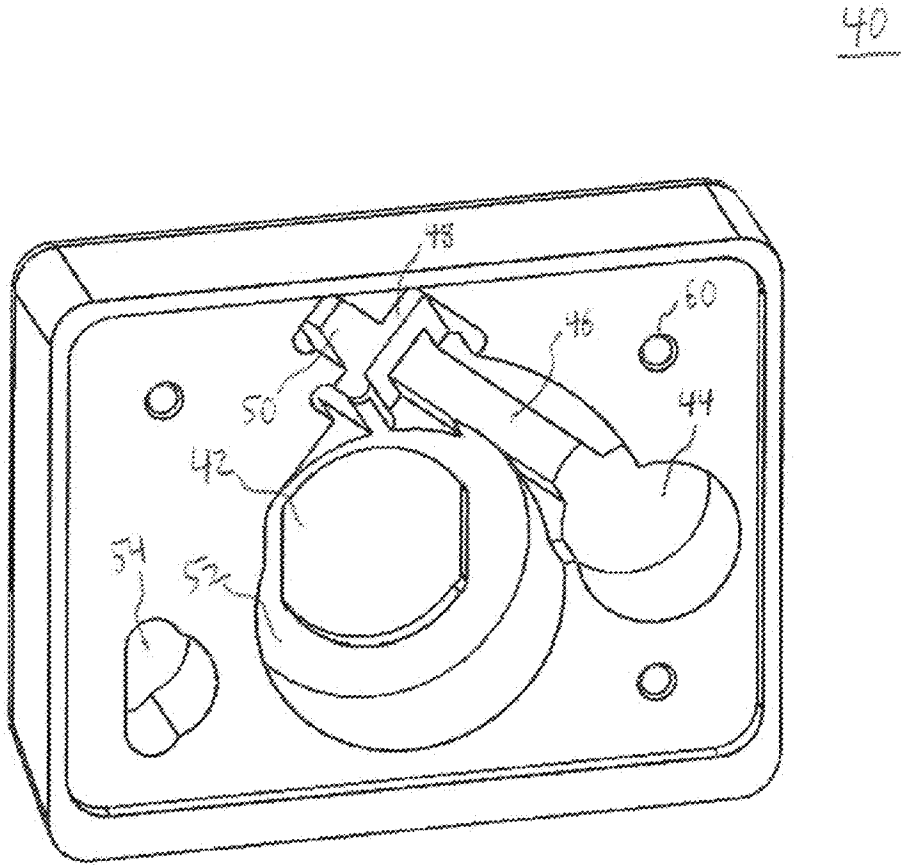
FIG. 3A schematically shows a safety selector lock body.
Figure 3B:
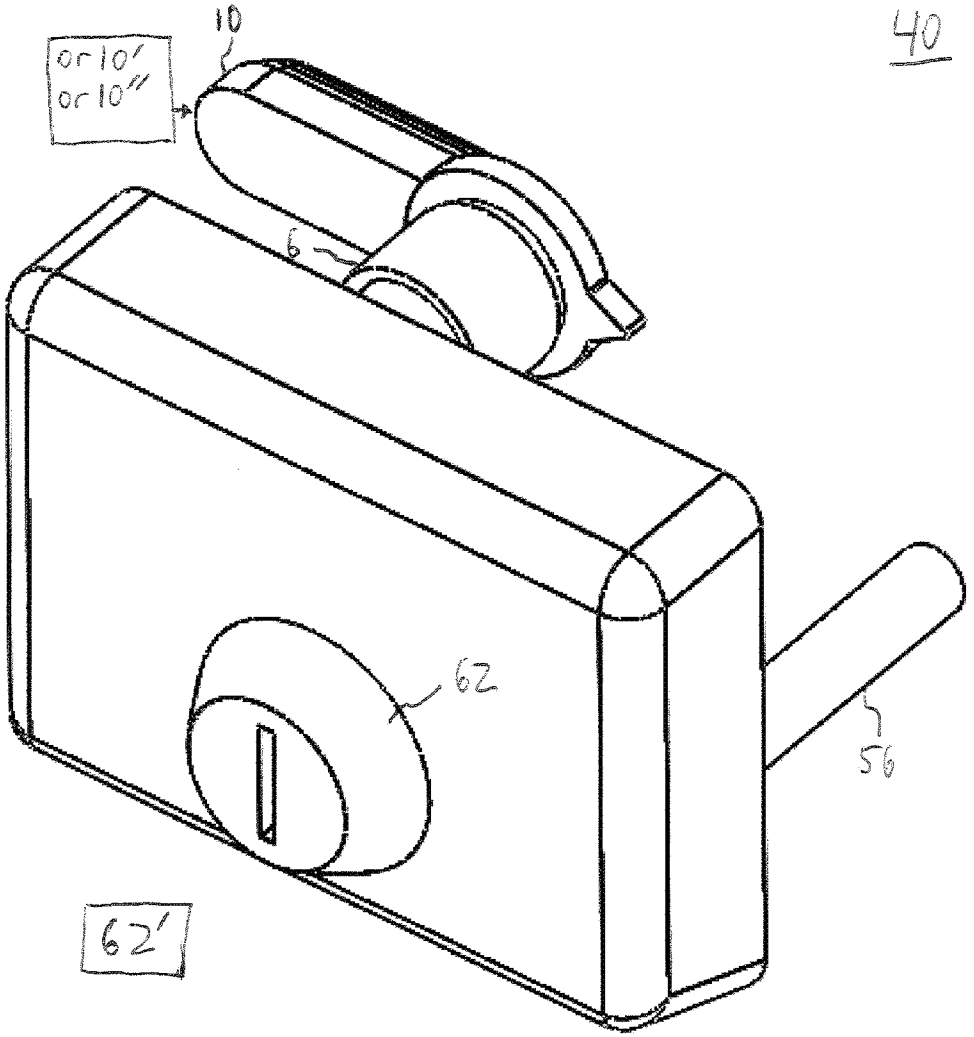
FIG. 3B schematically shows a safety selector lock body.

The engagement pin 12 can be retracted from the engagement hole 8 by applying a matching key 62' to a keyed lock 62 (see FIG. 3B). Applying a matching key 62' can comprise, for example, inserting and rotating a physical key such as a toothed or other shaped key, or applying a local or remote biometric or electronic key. Operation of the keyed lock 62 can be manual or motorized.

The keyed lock 62 engages a matching hole 20 in a keyed cam 22 and rotates the keyed cam 22. The keyed cam 20 comprises an arcuate cam portion 24. When the keyed cam 22 is rotated in an unlocking direction by the keyed lock 62 (counterclockwise, in embodiments and from the perspective as shown in, e.g., FIGS. 1 and 2), it pushes on the resistance plate 16, which retracts the engagement pin 12 from the engagement hole 8, allowing the safety selector 6 to rotate out of the SAFE position.

For firearms with two SAFE positions, in embodiments in which an engagement pin 10 can engage only a single engagement hole 6 (i.e., on a single location on the locking cap 4 corresponding to a single location of the safety selector lever 10), multiple DIFFERENT SAFE positions can be provided: a LOCKED SAFE position, requiring that the safety selector be unlocked (by turning the keyed cam 20) prior to turning the safety selector to a different (e.g., READY) position; and an OPEN SAFE position, which does not lock.

Two identically functioning SAFE positions can also be provided, e.g., using a locking cap 4 with engagement holes 8 (or an engagement hole 8 passing fully through the locking cap 4) corresponding to, and allowing engagement by the engagement pin 12 in, both SAFE positions.

FIG. 3A schematically shows a safety selector lock body 40; this view shows a side of the lock body 40 that, when installed on a firearm, faces towards the firearm. The lock body 40 comprises various recessed portions configured to hold the locking cap 4, the engagement pin 12 (including the resistance plate 16), the spring 14, the keyed cam 22 and the replacement trigger pin 56. In embodiments using a physical, insertable key, the lock body 40 can have a lock opening 42 for access to the keyed lock 62.

The recessed portions include a locking cap housing 44 where the locking cap 4 is located; a pin channel 46, which guides the engagement pin 12, and a wider resistance plate housing 48, in which the resistance plate 16 moves; a spring housing 50, in which the spring 14 is located; the cam housing 52, where the keyed cam 22 is located (and in which, in embodiments as shown in FIG. 5B, the keyed lock's 62 internal mechanism sits); and the replacement trigger pin housing 54, where an end of the replacement trigger pin 56 sits.

The resistance plate housing 48 limits the extent to which the engagement pin 12 can be moved back and forth by the spring 14 and the arcuate cam portion 24.

Preferably, the various housings, channels, and other voids in which the components of the locking safety sit are formed to fit closely to said components to enhance reliability, durability and ruggedness of the assembled safety lock 100.

The lock body 40 includes a replacement trigger pin 56 which inserts into the lock body 40, the portion of the replacement trigger pin 56 that is within the lock body 40 (with respect to the cover plate 70) being wider than the cover trigger pin hole 74, so that the replacement trigger pin 56 is securely held in the lock body 40 by the cover plate 70 when the safety lock is assembled.

Figure 6A:
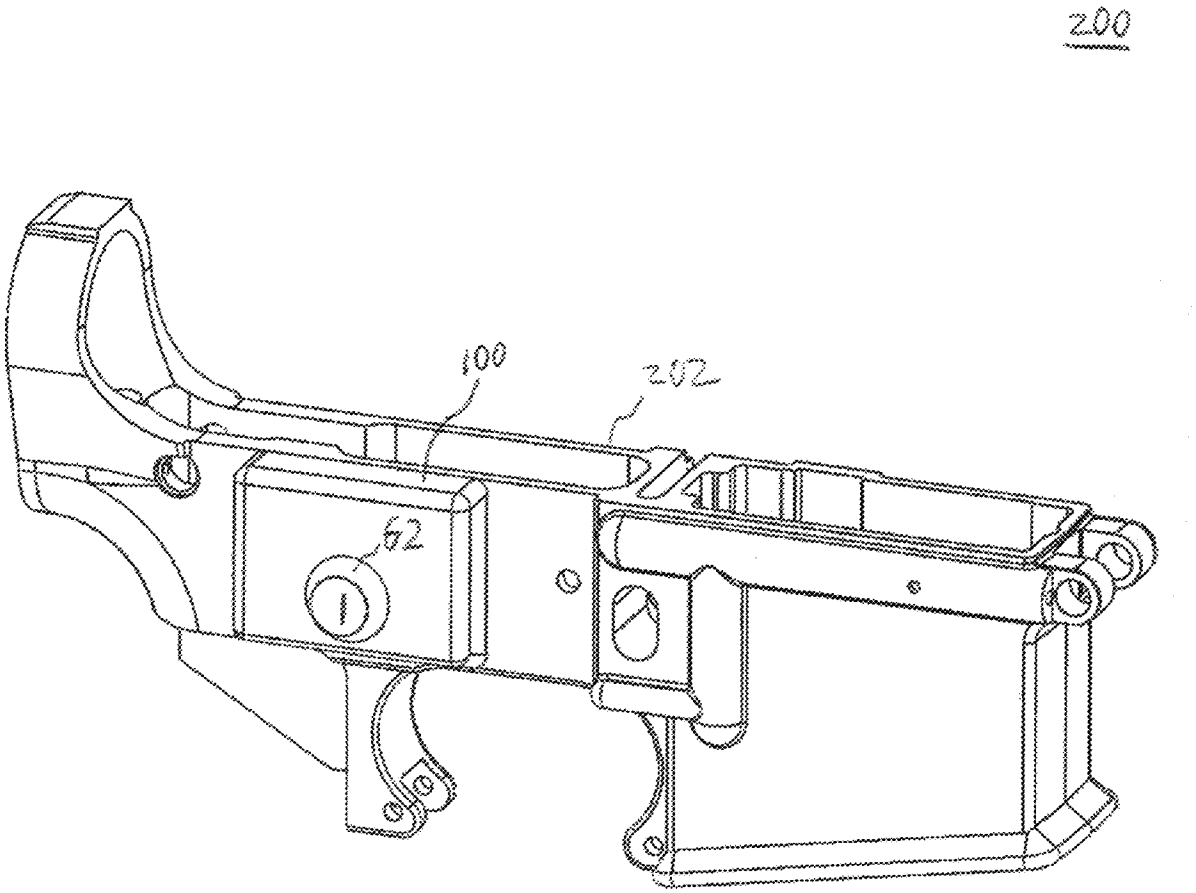
FIG. 6A schematically shows a lockable firearm body.
Figure 6B:
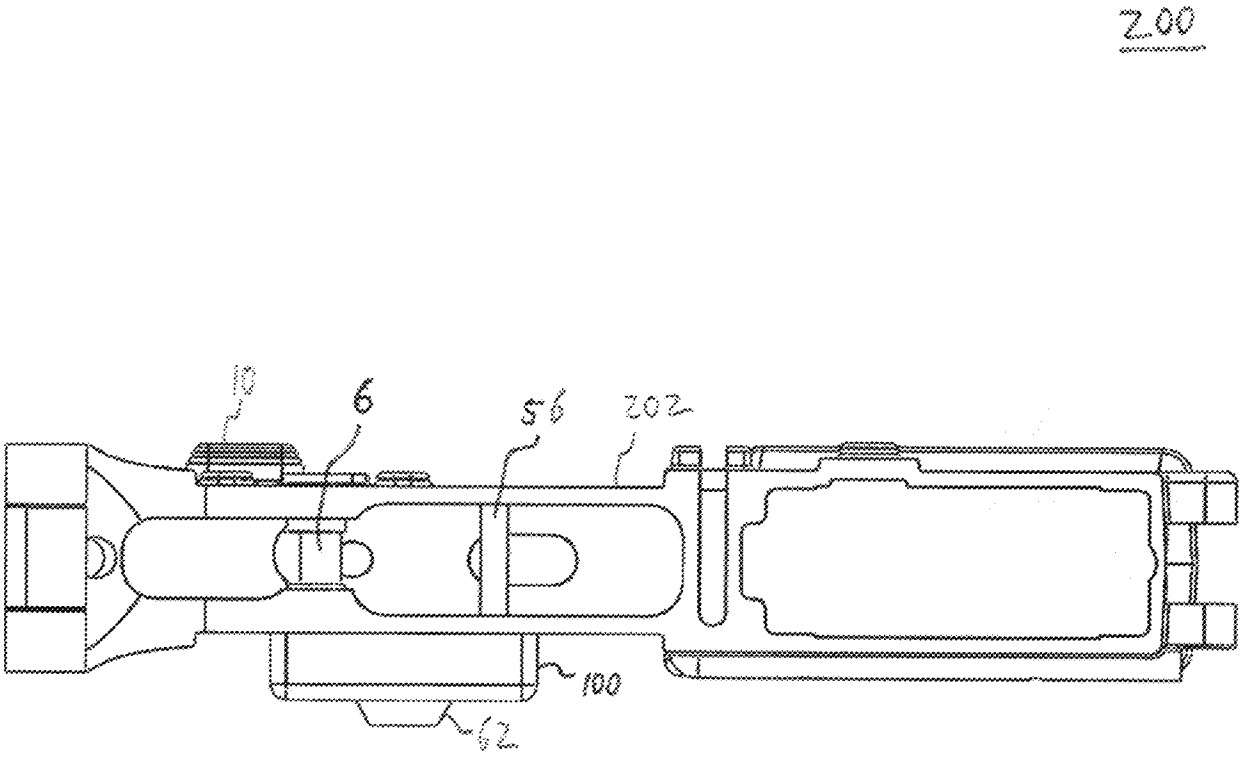
FIG. 6B schematically shows a lockable firearm body.
Figure 6C:
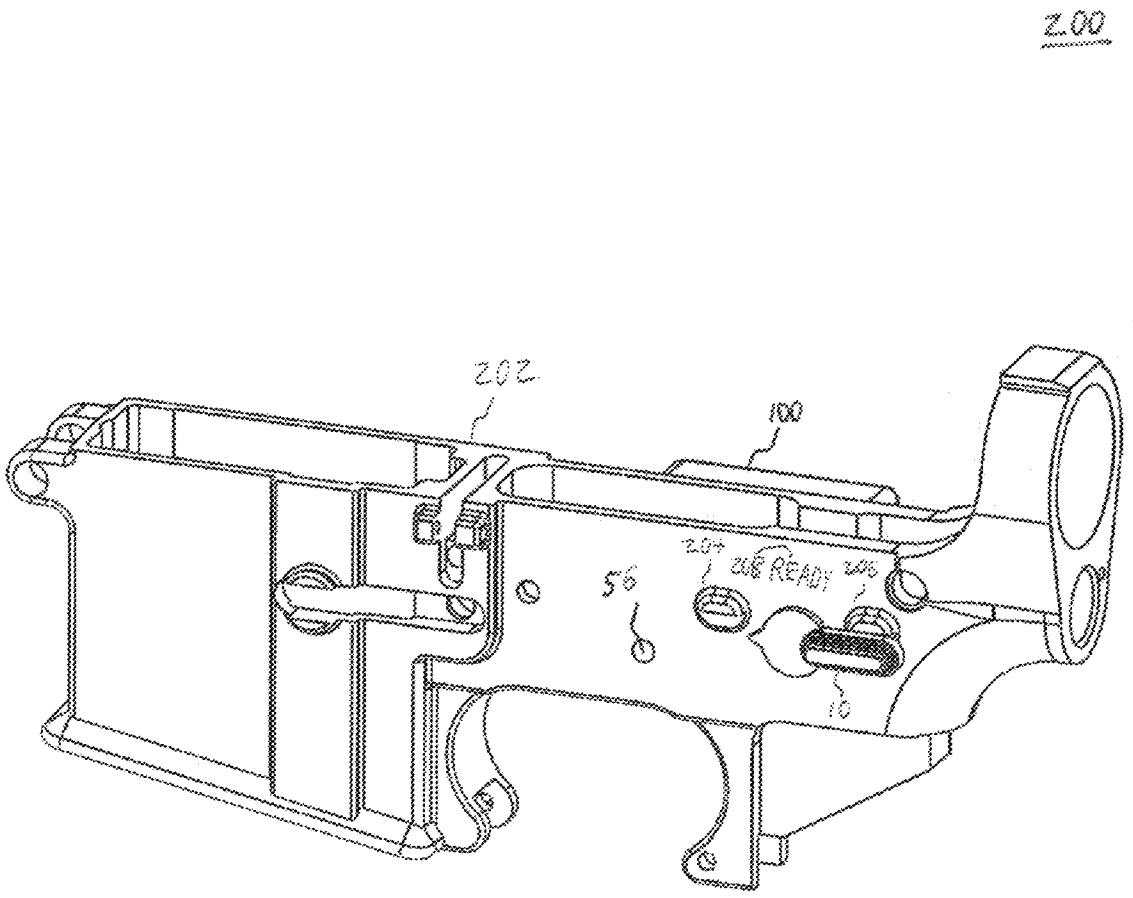
FIG. 6C schematically shows a lockable firearm body.

The replacement trigger pin 56 helps to prevent the assembled safety lock 100 from rotating against the firearm body 202 to which it is attached (see, e.g., FIGS. 6A and 6B). The replacement trigger pin 56 is also preferably adapted to hold the assembled safety lock 100 securely in place against the firearm body 202 (e.g., for an AR-15, the lower receiver, as shown in FIGS. 6A, 6B and 6C). For example, the end of the replacement trigger pin 56 can have a threaded hole (e.g., parallel to the main axis of the replacement trigger pin 56) so that a wide-headed screw can be used to secure the replacement trigger pin 56 against the side of the firearm body 202 opposite the lock body 40.

The lock body 40 also comprises screw holes 60 to allow the lock body 40 to be securely connected to the cover plate 70.

FIG. 3B schematically shows a safety selector lock body 40; this view shows a side of the lock body 40 that, when installed on a firearm, faces away from the firearm. The lock body 40 comprises a keyed lock 62 that engages the keyed cam 22. When the appropriate key is inserted into and rotated in the keyed lock 62, the keyed lock 62 causes the keyed cam 22 (with its arcuate cam portion 24) to rotate, engaging the resistance plate 16 and releasing the engagement pin 12 from the locking cap 4.

Figure 4:
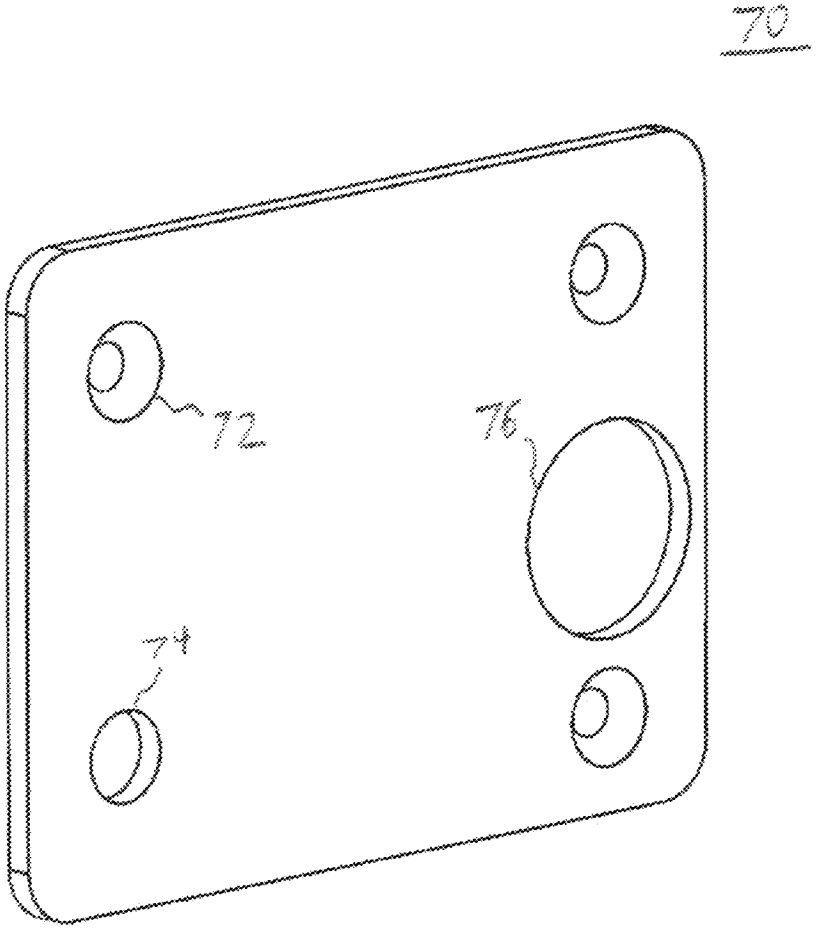
FIG. 4 schematically shows a safety selector lock cover plate.

FIG. 4 schematically shows a safety selector lock cover plate 70, which connects to and covers the lock body 40. The cover plate 70 has cover screw holes 72, allowing the cover plate 70 to be securely connected to the lock body 40. The cover plate 70 also has a cover trigger pin hole 74 for the replacement trigger pin 56, and an extended safety selector hole 76 for the extended safety selector 6.

Figure 5:
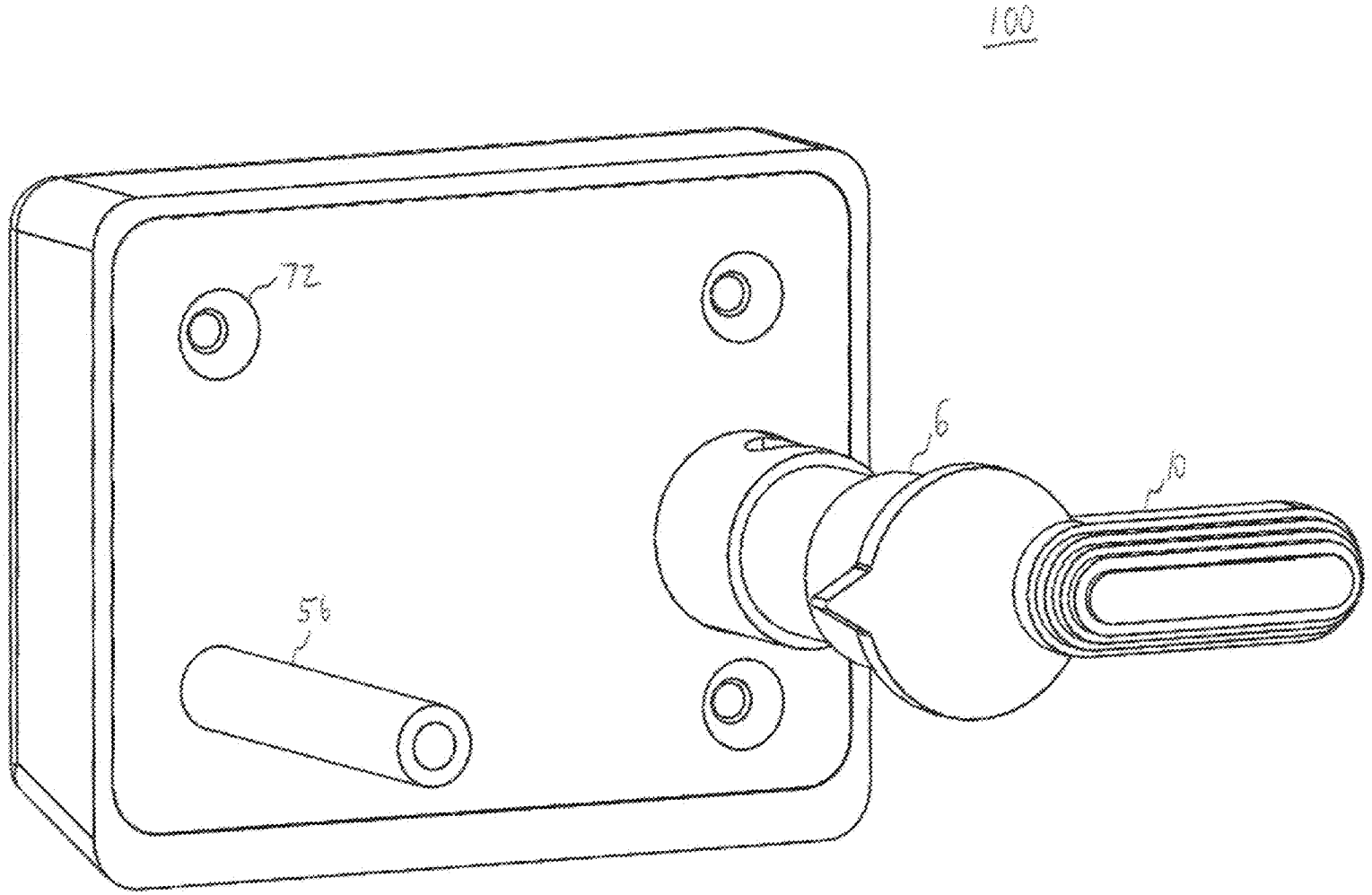
FIG. 5 schematically shows an assembled safety lock.

FIG. 5 schematically shows an assembled safety lock 100.

FIGS. 6A, 6B and 6C schematically show a lockable firearm body 200, comprising an assembled safety lock 100 mounted on a firearm body 202 (in embodiments as shown in FIGS. 6A, 6B and 6C, an AR-15 lower receiver). As shown in FIG. 6C, some firearms (including some AR-15s) comprise two SAFE positions (a first SAFE position 204 and a second SAFE position 206) and a READY position 208 allowing firearm discharge.

Figure 7:
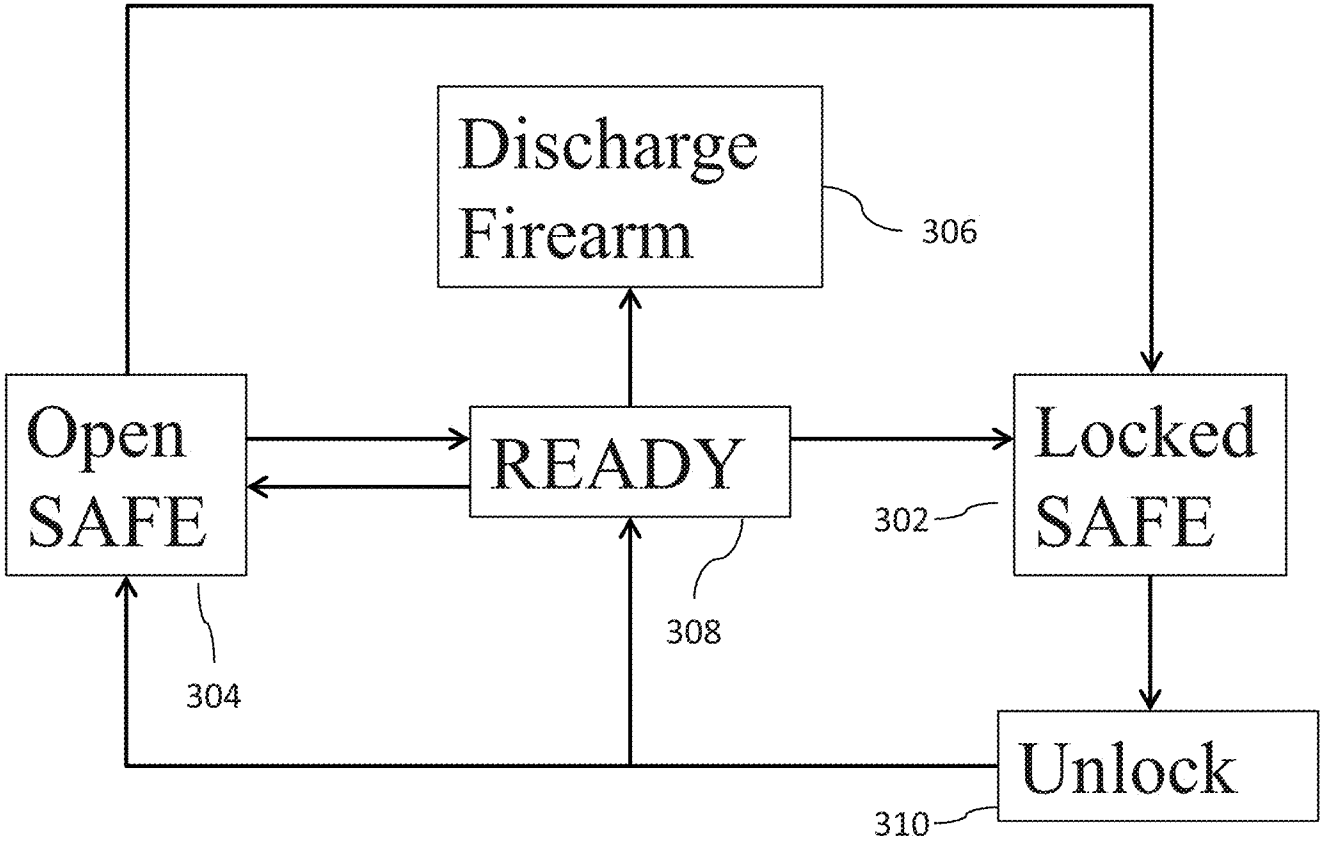
FIG. 7 shows a process for operating a firearm with a locking safety.

FIG. 7 shows a process for operating a firearm with a locking safety (with available state changes shown by lines and arrows). As disclosed with respect to, e.g., FIGS. 1, 2 and 6C, a locking firearm safety can be provided that has two DIFFERENT SAFE positions for a safety selector, i.e. a Locked SAFE position 302 and an Open Safe 304 position, both of which restrict the firearm from Discharge 306 (i.e., prevent the firearm from being fired); the firearm can only Discharge 306 when the safety selector in the READY position 308. The safety selector can be moved at will between the Open Safe 304 and READY 308 positions. However, if the safety selector is in the Locked SAFE position 302, a user must first Unlock 310 the safety selector before the safety selector can be changed to another position (the Open Safe position 304 or the READY position 308).

According to some but not necessarily all embodiments, there is provided: A locking firearm safety, comprising: a safety selector, connected to a safety indicator control on one end and to a locking cap on another end such that turning said safety indicator control turns said locking cap, and such that said safety selector indicator and said locking cap are exterior to the body of the firearm, said locking cap having at least one engagement hole; an engagement pin, configured to prevent said safety selector from rotating when said engagement pin engages said engagement hole; an elastic energy storer disposed to apply force to said engagement pin to cause it to engage said engagement hole when said safety selector is in a SAFE position.

According to some but not necessarily all embodiments, there is provided: A locking firearm safety, comprising: a safety selector, connected to a safety indicator control on one end and to a locking cap on another end such that turning said safety indicator control turns said locking cap, and such that said safety selector indicator and said locking cap are exterior to the body of the firearm, said locking cap having at least one engagement hole, said safety selector having more distinct SAFE positions than said locking cap has engagement holes; an engagement pin, configured to prevent said safety selector from rotating when said engagement pin engages said engagement hole; an elastic energy storer disposed to apply force to said engagement pin to cause it to engage said engagement hole when said safety selector is in a corresponding one of said SAFE positions.

According to some but not necessarily all embodiments, there is provided: A lockable firearm, comprising: a firearm body; a trigger assembly mounted on said firearm body; and a locking safety mounted on said firearm body and configured to prevent actuation of said trigger assembly when a safety indicator control is in a SAFE position, said locking safety comprising: a safety selector, connected to a safety indicator control on one end and to a locking cap on another end such that turning said safety indicator control turns said locking cap, and such that said safety selector indicator and said locking cap are exterior to the body of the firearm, said locking cap having at least one engagement hole, said safety selector having more distinct SAFE positions than said locking cap has engagement holes; an engagement pin, configured to prevent said safety selector from rotating when said engagement pin engages said engagement hole; an elastic energy storer disposed to apply force to said engagement pin to cause it to engage said engagement hole when said safety selector is in a corresponding one of said SAFE positions.

According to some but not necessarily all embodiments, there is provided: A lockable firearm, comprising: a firearm body; a trigger assembly mounted on said firearm body; and a locking safety mounted on said firearm body and configured to prevent actuation of said trigger assembly when a safety indicator control is in a SAFE position, said locking safety comprising: a safety selector connected to said safety indicator control on one end and to a locking cap on another end such that turning said safety indicator control turns said locking cap, and such that said safety selector indicator and said locking cap are exterior to the body of the firearm, said locking cap having at least one engagement hole; an engagement pin, configured to prevent said safety selector from rotating when said engagement pin engages said engagement hole; an elastic energy storer disposed to apply force to said engagement pin to cause it to engage said engagement hole when said safety selector is in a SAFE position.

According to some but not necessarily all embodiments, there is provided: A method for operating a firearm, comprising: selecting one of at least three different positions for a safety selector, said positions comprising: a READY position, in which said firearm can be discharged; an OPEN SAFE position, in which said safety selector position can be changed to said READY position without unlocking said safety selector, and preventing said firearm from discharging; and a LOCKED SAFE position preventing said safety selector position from being changed and preventing said firearm from discharging; and applying a matching key to a corresponding lock connected to said safety selector to thereby allow said safety selector position to be changed from said LOCKED SAFE position.

According to some but not necessarily all embodiments, there is provided: Methods and systems for locking and operating firearms, particularly rifle models that have a safety selector that extends through the width of the weapon body. For example, a safety selector lock can be configured to attach to the lower receiver of an AR-15. A replacement, extended safety selector allows installation of a safety selector lock outside the body of the firearm, avoiding modification of the weapon's firing components. The safety selector is locked by an engagement pin engaging an engagement hole on a locking cap connected to an end of the safety selector, outside the weapon body. Some weapons have two SAFE positions; disclosed embodiments can provide two DIFFERENT SAFE positions—a OPEN SAFE (unlocked) and a LOCKED SAFE. By using an engagement hole with a single opening, the engagement pin engages the engagement hole, thus locking the safety selector, in only one of the SAFE positions.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

As will be apparent to one of ordinary skill in the arts of rifle manufacture, while particular arrangements of and types of connection between the lock body and/or cover plate, the keyed lock, the lock mechanism, the extended safety selector and the rifle body are described herein, various other arrangements and types of connection can also be used.

In some embodiments, a safety selector lock as disclosed herein is manufactured and/or sold and/or otherwise assembled with a corresponding firearm.

As will be apparent to one of ordinary skill in the arts of rifle manufacture, various types of key and corresponding lock can be used, such as biometric, Bluetooth or other unlock-on-activation technology (EMF, photonic or aural signal), RFID or other unlock-on-proximity technology (e.g., EMF, photonic or aural signal), keypad, touch screen (e.g., alphanumeric and/or geometric and/or rhythmic key), or insertable electronic key.

In some embodiments, keys can be applied to corresponding locks by one or more of: direct application (keyhole, pad, receiver, sensor or other key interface attached to the weapon); local application (key interface proximate and connected to the weapon); or remote application (key interface physically removed from the weapon, with the lock configured to receive a remote unlock signal).

In some embodiments using a keyed lock with a physical key that is inserted into and turned in the lock to effect unlock, when the keyed lock is returned to a non-unlocked position, the spring 12 pushes on the resistance plate 14 which pushes on the arcuate portion 22, causing the keyed cam 20 to rotate into a non-unlocked position.

As will be apparent to one of ordinary skill in the arts of rifle manufacture, the locking cap can be instantiated as a cylinder or in a wide variety of other shapes (e.g., as a half-moon or other part-circle or curved cross-section, as an ovoid cylinder, or as a shape with a main axis displaced from the main axis of the safety selector).

In some embodiments, as shown in FIG. 3B, a safety indicator control other than a lever is used, e.g., a knob 10' or switch 10".

As will be apparent to one of ordinary skill in the arts of rifle manufacture, while particular types of safety have been referred to herein, various types of safety compatible with a safety selector can be used.

In some embodiments, an intermediate third (or more) safety selector position is accommodated, which does not allow weapon discharge but does allow a bolt action to be opened to unload the firearm.

In some embodiments, the safety selector lock prevents a firearm from being disassembled unless the safety selector lock is unlocked.

In some embodiments, the keyed cam (or the keyed lock engaging the keyed cam) comprises a spring or other elastic component that rotates it into a locked position when the key is not being actively turned.

In some embodiments, an elastic energy storer (e.g., storing energy upon compression and/or extension, and consequently applying force to release said energy by returning to a less compressed or extended state) other than a spring (e.g., a rubber cylinder or elastic band) is used to cause the engagement pin to engage the engagement hole.

In some embodiments, a locking cap has the same number of holes or hole openings as the safety selector has SAFE positions, said holes or hole openings positioned to correspond to said SAFE positions.

In some embodiments, a locking cap has two or more holes or hole openings, comprising fewer holes or hole openings than the safety selector has SAFE positions, said holes or hole openings positioned to correspond to said SAFE positions.

In some embodiments, a single position on the locking cap corresponds to multiple positions of the safety selector lever (e.g., as a result of gearing causing the locking cap and the safety selector lever to rotate asynchronously).

In some embodiments providing two different SAFE positions, the locking cap, engagement pin and keyed cam can be located inside the weapon body.

Additional general background, which helps to show variations and implementations, may be found in the following publications, all of which are hereby incorporated by reference: U.S. Pat. No. 8,650,789 and U.S. Pat. No. 3,882,622.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A locking firearm safety, comprising:

a safety selector, connected to a safety indicator control on one end and to a locking cap on another end such that turning said safety indicator control turns said locking cap, and such that said safety selector indicator and said locking cap are configured to be mounted on an exterior to a body of a firearm such that said safety selector and said locking cap remain exterior to said receiver when so mounted, said locking cap having at least one engagement hole;

an engagement pin, configured to prevent said safety selector from rotating when said engagement pin engages said engagement hole;

an elastic energy storer disposed to apply force to said engagement pin to cause said engagement pin to engage said engagement hole when said safety selector is in a SAFE position.

2. The locking firearm safety of claim 1, wherein said safety selector prevents operation of a firearm trigger assembly when said safety selector is in said SAFE position.

3. The locking firearm safety of claim 1, wherein said safety indicator control comprises a lever, knob or switch.

4. The locking firearm safety of claim 1, further comprising a keyed cam configured to cause said engagement pin to disengage from said engagement hole when a matching key is applied to a keyed lock engaging said keyed cam.

5. The locking firearm safety of claim 1, wherein said engagement pin comprises a resistance portion fixedly connected thereto; and further comprising a keyed cam having a keyhole and an arcuate portion, said arcuate portion configured to press said resistance portion away from said engagement hole sufficiently to cause said engagement pin to disengage from said engagement hole when said keyed cam is rotated into an unlock position.

6. The locking firearm safety of claim 1, wherein said engagement pin does not engage said engagement hole when said safety selector is not in said SAFE position.

7. The locking firearm safety of claim 1, wherein said engagement hole does not fully penetrate said locking cap.

8. The locking firearm safety of claim 1, wherein said locking cap is removable from said safety selector.

9. The locking firearm safety of claim 1, further comprising a replacement trigger pin fixedly connected to a lock body configured to house said locking cap, said engagement pin and said elastic energy storer, said replacement trigger pin fixedly connectable to said firearm body.

10. The locking firearm safety of claim 9, wherein said replacement trigger pin has a threaded hole on an end opposite said lock body.

11. A locking firearm safety, comprising:

a safety selector, connected to a safety indicator control on one end and to a locking cap on another end such that turning said safety indicator control turns said locking cap, and such that said safety indicator control and said locking cap are configured to be mounted on an exterior to a body of a firearm, said locking cap having at least one engagement hole, said safety selector having more distinct SAFE positions than said locking cap has engagement holes;

an engagement pin, configured to prevent said safety selector from rotating when said engagement pin engages said engagement hole;

an elastic energy storer disposed to apply force to said engagement pin to cause said engagement pin to engage said engagement hole when said safety selector is in a corresponding one of said SAFE positions.

12. The locking firearm safety of claim 11, whereby said safety selector has multiple different SAFE positions, comprising one or more SAFE positions locked by said engagement pin, and one or more SAFE positions not locked by said engagement pin.

13. The locking firearm safety of claim 11, wherein said locking cap has one engagement hole and said safety selector has two distinct SAFE positions, whereby said safety selector has one SAFE position locked by said engagement pin and one SAFE position not locked by said engagement pin.

14. The locking firearm safety of claim 11, wherein said safety selector prevents operation of a firearm trigger assembly when said safety selector is in one of said SAFE positions.

15. The locking firearm safety of claim 11, wherein said safety indicator control comprises a lever, knob or switch.

16. The locking firearm safety of claim 11, further comprising a keyed cam configured to cause said engagement pin to disengage from said engagement hole when a matching key is applied to a keyed lock engaging said keyed cam.

17. The locking firearm safety of claim 11, wherein said engagement pin comprises a resistance portion fixedly connected thereto; and further comprising a keyed cam having a keyhole and an arcuate portion, said arcuate portion configured to press said resistance portion away from said engagement hole sufficiently to cause said engagement pin to disengage from said engagement hole when said keyed cam is rotated into an unlock position.

18. The locking firearm safety of claim 11, wherein said engagement pin does not engage said engagement hole when said safety selector is not in said SAFE position.

19. The locking firearm safety of claim 11, wherein said engagement hole does not fully penetrate said locking cap.

20. The locking firearm safety of claim 11, wherein said locking cap is removable from said safety selector.

21. The locking firearm safety of claim 11, further comprising a replacement trigger pin fixedly connected to a lock body configured to house said locking cap, said engagement pin and said elastic energy storer, said replacement trigger pin fixedly connectable to said firearm body.

22. The locking firearm safety of claim 21, wherein said replacement trigger pin has a threaded hole on an end opposite said lock body.

23. A lockable firearm, comprising:

a firearm body;

a trigger assembly mounted on said firearm body; and a locking safety mounted on said firearm body and configured to prevent actuation of said trigger assembly when a safety indicator control is in a SAFE position, said locking safety comprising:

a safety selector, connected to said safety indicator control on one end and to a locking cap on another end such that turning said safety indicator control turns said locking cap, and such that said safety indicator control and said locking cap are exterior to said firearm body, said locking cap having at least one engagement hole, said safety selector having more distinct SAFE positions than said locking cap has engagement holes;

an engagement pin, configured to prevent said safety selector from rotating when said engagement pin engages said engagement hole;

an elastic energy storer disposed to apply force to said engagement pin to cause said engagement pin to engage said engagement hole when said safety selector is in a corresponding one of said SAFE positions.

24. The lockable firearm of claim 23, wherein said safety selector prevents operation of said trigger assembly when said safety selector is in one of said SAFE positions.

25. The lockable firearm of claim 23, wherein said safety indicator control comprises a lever, knob or switch.

26. The lockable firearm of claim 23, further comprising a keyed cam configured to cause said engagement pin to disengage from said engagement hole when a matching key is applied to a keyed lock engaging said keyed cam.

27. The lockable firearm of claim 23, wherein said engagement pin comprises a resistance portion fixedly connected thereto; and further comprising a keyed cam having a keyhole and an arcuate portion, said arcuate portion configured to press said resistance portion away from said engagement hole sufficiently to cause said engagement pin to disengage from said engagement hole when said keyed cam is rotated into an unlock position.

28. The lockable firearm of claim 23, wherein said engagement pin does not engage said engagement hole when said safety selector is not in said SAFE position.

29. The lockable firearm of claim 23, wherein said engagement hole does not fully penetrate said locking cap.

30. The lockable firearm of claim 23, wherein said locking cap is removable from said safety selector.

31. The lockable firearm of claim 23, further comprising a replacement trigger pin fixedly connected to a lock body configured to house said locking cap, said engagement pin and said elastic energy storer, said replacement trigger pin fixedly connectable to said firearm body.

32. The lockable firearm of claim 31, wherein said replacement trigger pin has a threaded hole on an end opposite said lock body.

33. A lockable firearm, comprising:

a firearm body;

a trigger assembly mounted on said firearm body; and a locking safety mounted on said firearm body and configured to prevent actuation of said trigger assembly when a safety indicator control is in a SAFE position, said locking safety comprising:

a safety selector connected to said safety indicator control on one end and to a locking cap on another end such that turning said safety indicator control turns said locking cap, and such that said safety indicator control and said locking cap are mounted on an exterior to said firearm body such that said safety indicator control and said locking cap remain exterior to said receiver when so mounted, said locking cap having at least one engagement hole;

an engagement pin, configured to prevent said safety selector from rotating when said engagement pin engages said engagement hole;

an elastic energy storer disposed to apply force to said engagement pin to cause said engagement pin to engage said engagement hole when said safety selector is in said SAFE position.

34. The lockable firearm of claim 33, whereby said safety selector has multiple different SAFE positions, comprising one or more SAFE positions locked by said engagement pin, and one or more SAFE positions not locked by said engagement pin.

35. The lockable firearm of claim 33, wherein said locking cap has one engagement hole and said safety selector has two distinct SAFE positions, whereby said safety selector has one SAFE position locked by said engagement pin and one SAFE position not locked by said engagement pin.

36. The lockable firearm of claim 33, wherein said safety selector prevents operation of a firearm trigger assembly when said safety selector is in said SAFE position.

37. The lockable firearm of claim 33, wherein said safety indicator control comprises a lever, knob or switch.

38. The lockable firearm of claim 33, further comprising a keyed cam configured to cause said engagement pin to disengage from said engagement hole when a matching key is applied to a keyed lock engaging said keyed cam.

39. The lockable firearm of claim 33, wherein said engagement pin comprises a resistance portion fixedly connected thereto; and further comprising a keyed cam having a keyhole and an arcuate portion, said arcuate portion configured to press said resistance portion away from said engagement hole sufficiently to cause said engagement pin to disengage from said engagement hole when said keyed cam is rotated into an unlock position.

40. The lockable firearm of claim 33, wherein said engagement pin does not engage said engagement hole when said safety selector is not in said SAFE position.

41. The lockable firearm of claim 33, wherein said engagement hole does not fully penetrate said locking cap.

42. The lockable firearm of claim 33, wherein said locking cap is removable from said safety selector.

43. The lockable firearm of claim 33, further comprising a replacement trigger pin fixedly connected to a lock body configured to house said locking cap, said engagement pin and said elastic energy storer, said replacement trigger pin fixedly connectable to said firearm body.

44. The lockable firearm of claim 43, wherein said replacement trigger pin has a threaded hole on an end opposite said lock body.

* * * * *